US007353544B1

(12) United States Patent
Kleinert

(10) Patent No.: US 7,353,544 B1
(45) Date of Patent: Apr. 8, 2008

(54) BASEBALL GLOVE

(75) Inventor: James M. Kleinert, Louisville, KY (US)

(73) Assignee: Hillerich & Bradsby Co., Louisville, KY (US)

( * ) Notice: Subject to any disclaimer, the term of this patent is extended or adjusted under 35 U.S.C. 154(b) by 173 days.

(21) Appl. No.: 11/181,472

(22) Filed: Jul. 14, 2005

(51) Int. Cl.
*A41D 13/08* (2006.01)

(52) U.S. Cl. ..... 2/19; 2/161.1

(58) Field of Classification Search ..... 2/19, 2/16, 161.1, 159, 160
See application file for complete search history.

(56) References Cited

U.S. PATENT DOCUMENTS

| | | | | |
|---|---|---|---|---|
| 325,968 | A | | 9/1885 | Rawlings |
| 1,018,271 | A | | 2/1912 | Rogers |
| 1,496,824 | A | | 6/1924 | Nixon |
| 2,528,802 | A | | 11/1950 | Turner |
| 3,300,787 | A | * | 1/1967 | Denkert ..... 2/19 |
| 3,532,344 | A | * | 10/1970 | Masstab ..... 473/205 |
| 3,576,036 | A | | 4/1971 | Latina |
| 4,590,625 | A | | 5/1986 | Keim |
| 4,748,690 | A | * | 6/1988 | Webster ..... 2/161.1 |
| 4,847,915 | A | * | 7/1989 | Keene ..... 2/19 |
| 5,168,578 | A | | 12/1992 | Stanley |
| 5,195,188 | A | | 3/1993 | Bourdeau et al. |
| 5,218,719 | A | | 6/1993 | Johnson |
| 5,557,803 | A | | 9/1996 | Granich et al. |
| 5,575,005 | A | | 11/1996 | Walker et al. |
| 5,592,688 | A | | 1/1997 | LaRonge et al. |
| 5,644,795 | A | * | 7/1997 | Landis et al. ..... 2/161.3 |
| 5,694,642 | A | | 12/1997 | Rector et al. |
| 5,708,979 | A | | 1/1998 | Redwood et al. |
| 5,717,994 | A | | 2/1998 | Goldsmith |
| 5,799,327 | A | * | 9/1998 | Clevenhagen ..... 2/19 |
| 5,887,282 | A | | 3/1999 | Lenhart |
| 5,926,847 | A | | 7/1999 | Eibert |
| 5,987,642 | A | | 11/1999 | Webster |
| D417,757 | S | | 12/1999 | Aoki |
| D420,173 | S | | 2/2000 | Aoki |
| D420,174 | S | | 2/2000 | Aoki |
| 6,182,289 | B1 | | 2/2001 | Brown |
| 6,253,382 | B1 | | 7/2001 | Kleinert |
| 6,289,515 | B1 | | 9/2001 | Fous |

(Continued)

*Primary Examiner*—Katherine Moran
*Assistant Examiner*—Richale L Haney Quinn
(74) *Attorney, Agent, or Firm*—Charles G. Lamb; Middleton Reutlinger

(57) ABSTRACT

A ball glove having a plurality of pads on the palm side of the glove to facilitate glove closure based on the true axis of rotation of the metacarpalphalangeal joints of the fingers and the carpometacarpal joint of the thumb. The pads include a triangular shaped palm pad placed between the wrist, the center axis of rotation of the thumb carpometacarpal joint and the center axis of rotation of the small finger and the ring finger metacarpalphalangeal joints. A finger pad is disposed distally of the center axis of rotation of the ring finger and small finger metacarpalphalangeal joints and a thumb pad is positioned distally of the center axis of rotation of the carpometacarpal joint of the thumb. Flex lines are defined by lacing positioned to extend from one edge of the glove below the thumb to the web of the glove on one side and from an opposite edge of the glove below a finger stall for the small finger and the ring finger to the juncture of the small finger and ring finger stall with a finger stall for the long finger.

15 Claims, 6 Drawing Sheets

U.S. PATENT DOCUMENTS 6,389,601 B2 5/2002 Kleinert
6,415,444 B1 7/2002 Kleinert
6,430,745 B2 8/2002 Murai
6,453,474 B2 * 9/2002 Kleinert ..... 2/161.1
6,460,184 B1 10/2002 Nishimura et al.
6,502,244 B1 1/2003 Kleinert
6,732,377 B1 * 5/2004 Wilkinson ..... 2/161.4
6,775,847 B2 * 8/2004 Terris et al. ..... 2/161.1

* cited by examiner

BASEBALL GLOVE

BACKGROUND OF THE INVENTION

1. Field of the Invention

This invention relates to gloves for the human hand which are worn when playing sports, such as baseball, softball and the like. More particularly, this invention relates to a baseball glove which includes additional padding and lacing to facilitate and improve closure of the glove.

2. Description of Related Art

Glove construction for protection of the human hand is well known. In addition, there are a number of patents which teach gloves claimed to be particularly useful in the playing of sports. For example, in baseball there are a number of patents relating to glove use for batting as well as those used when in the field in the catching of balls. Fielders' gloves in baseball, which includes softball, are generally constructed in a fashion wherein they are difficult to close and this is especially true when the gloves are new. These gloves are generally constructed to close or "break" along a flex line which starts at the side of the glove adjacent to the center axis of rotation of the metacarpalphalangeal joint of the small finger and extends diagonally across the pocket of the glove adjacent to the center axis of rotation of the metacarpalphalangeal joints of the fingers, terminating at the web of the glove which is between the thumb and the index finger. This "break" or flex line requires substantial force to be applied by the fingers of the hand in the closure of the glove. Thus, there is a need for baseball fielders' gloves which are relatively easy to flex and close with little effort being exerted by the fingers.

SUMMARY OF THE INVENTION

It is an object of the present invention to provide a baseball (softball) glove for use by players in the catching of a baseball or softball.

It is another object of the present invention to provide a baseball glove which is constructed to enable or facilitate easy closure of the glove upon catching of a ball.

It is a further object of the present invention to provide a baseball glove which includes zones free of padding at selected areas to enhance the closure of the glove.

More particularly, the present invention provides a ball glove having a palm side, a dorsal side, a thumb stall, a plurality of finger stalls for receipt of the index finger, the long finger, the ring finger and the small finger, and an opening for receiving a persons hand therein. A palm pad is disposed on the palm side of the glove and positioned to be between the wrist, the center axis of rotation of the carpometacarpal joint of the thumb and the center axis of rotation of the metacarpalphalangeal joints of the long finger, the ring finger and the small finger. Finger padding may also be added to extend distally from the center axis of rotation of the metacarpalphalangeal joints of the small finger, as well as the ring finger and the long finger, a thumb pad may be added to extend distally from the center axis of rotation of the carpometacarpal joint of the thumb. The palm side of the glove is absent of padding over the center axis of rotation of the carpometacarpal joint of the thumb and the metacarpalphalangeal joints of the long finger, the ring finger and the small finger.

Other objects and advantages of the present invention will appear from the following description and appended claims, reference being had to accompanying drawings forming a part of the specification wherein like reference characters designate corresponding parts into several views. Moreover, in the use of the term "baseball or ball glove", it is intended to include, for example, baseball and softball gloves, mitts, and gloves for other athletic endeavors.

DESCRIPTION OF THE PREFERRED EMBODIMENT

Figure 1:
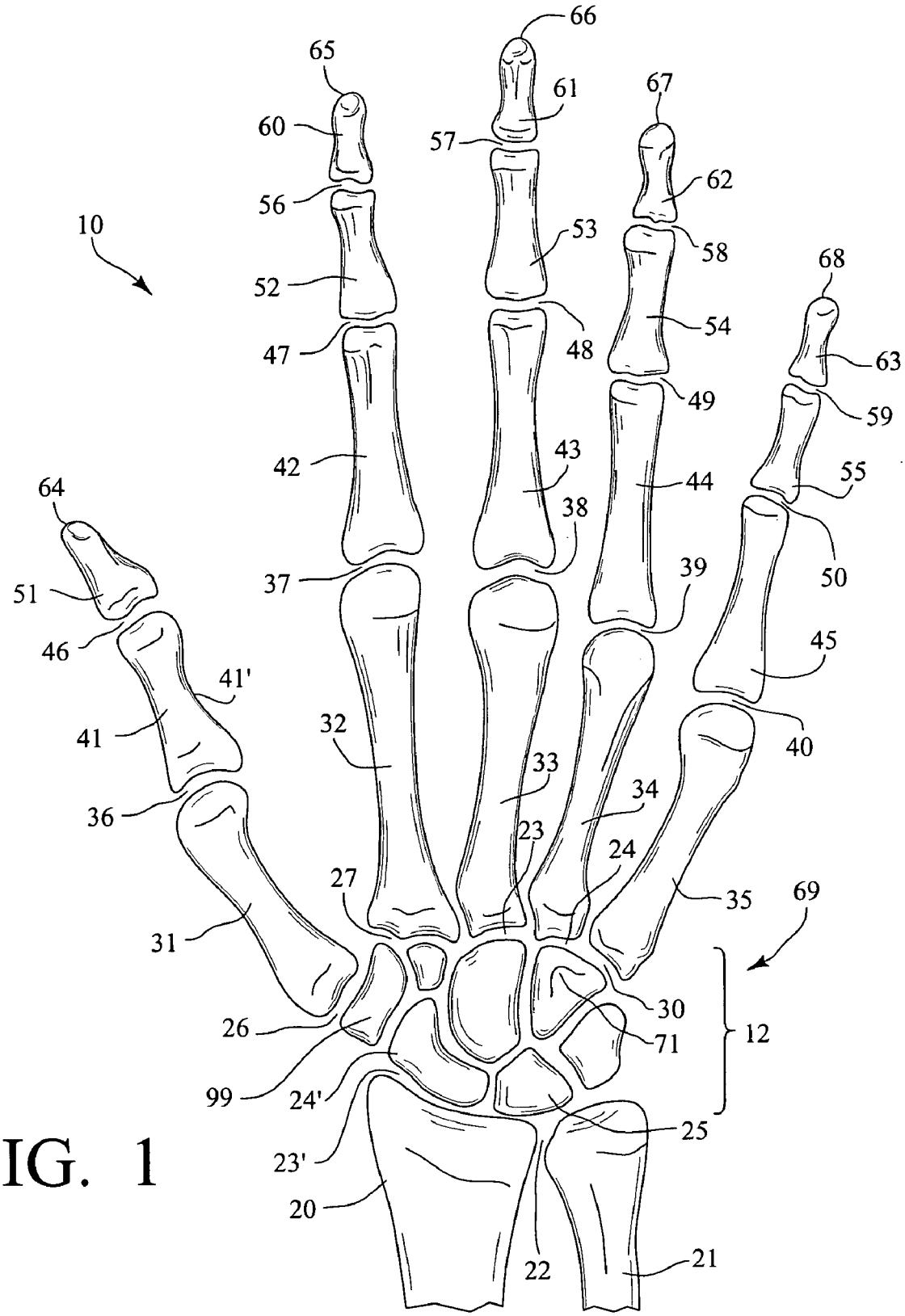
FIG. 1 is a bottom schematic anatomical view of the bones of a left-side human hand showing the palm-side details.

FIG. 1 is a schematic anatomical view of the bones of a left human hand 10 looking at a palm side 18. Shown are the radius 20, ulna 21, radiocarpal joint (RC) 23', distal radio ulnar joint (DRUJ) 22, wrist 12, thumb 64, index finger 65, long finger 66, ring finger 67, and small finger 68. The carpus 69 comprises eight carpal bones, seven of which are shown in FIG. 1 and includes the hamate bone 71 with its hook-like protrusion, the scaphoid 24', the trapezium 99 and the lunate 25.

The thumb 64 is comprised of the distal phalanx 51, the interphalangeal joint (IP) 46, proximal phalanx 41, diaphysis of proximal phalanx 41', metacarpalphalangeal joint (MCP) 36, metacarpal 31, and carpometacarpal joint (CMC) 26.

The index finger 65 is comprised of the distal phalanx 60, distal interphalangeal joint (DIP) 56, middle phalanx 52, proximal interphalangeal joint (PIP) 47, proximal phalanx 42, metacarpalphalangeal joint (MCP) 37, metacarpal 32, and carpometacarpal joint (CMC) 27.

The long finger 66 is comprised of the distal phalanx 61, distal interphalangeal joint (DIP) 57, middle phalanx 53, proximal interphalangeal joint (PIP) 48, proximal phalanx 43, metacarpalphalangeal joint (MCP) 38, metacarpal 33, and carpometacarpal joint (CMC) 23.

The ring finger 67 is comprised of the distal phalanx 62, distal interphalangeal joint (DIP) 58, middle phalanx 54, proximal interphalangeal joint (PIP) 49, proximal phalanx 44, metacarpalphalangeal joint (MCP) 39, metacarpal 34, and carpometacarpal joint (CMC) 24.

The small finger 68 is comprised of the distal phalanx 63, distal interphalangeal joint (DIP) 59, middle phalanx 55, proximal interphalangeal joint (PIP) 50, proximal phalanx 45, metacarpalphalangeal joint (MCP) 40, metacarpal 35, and carpometacarpal joint (CMC) 30.

Figure 1A:
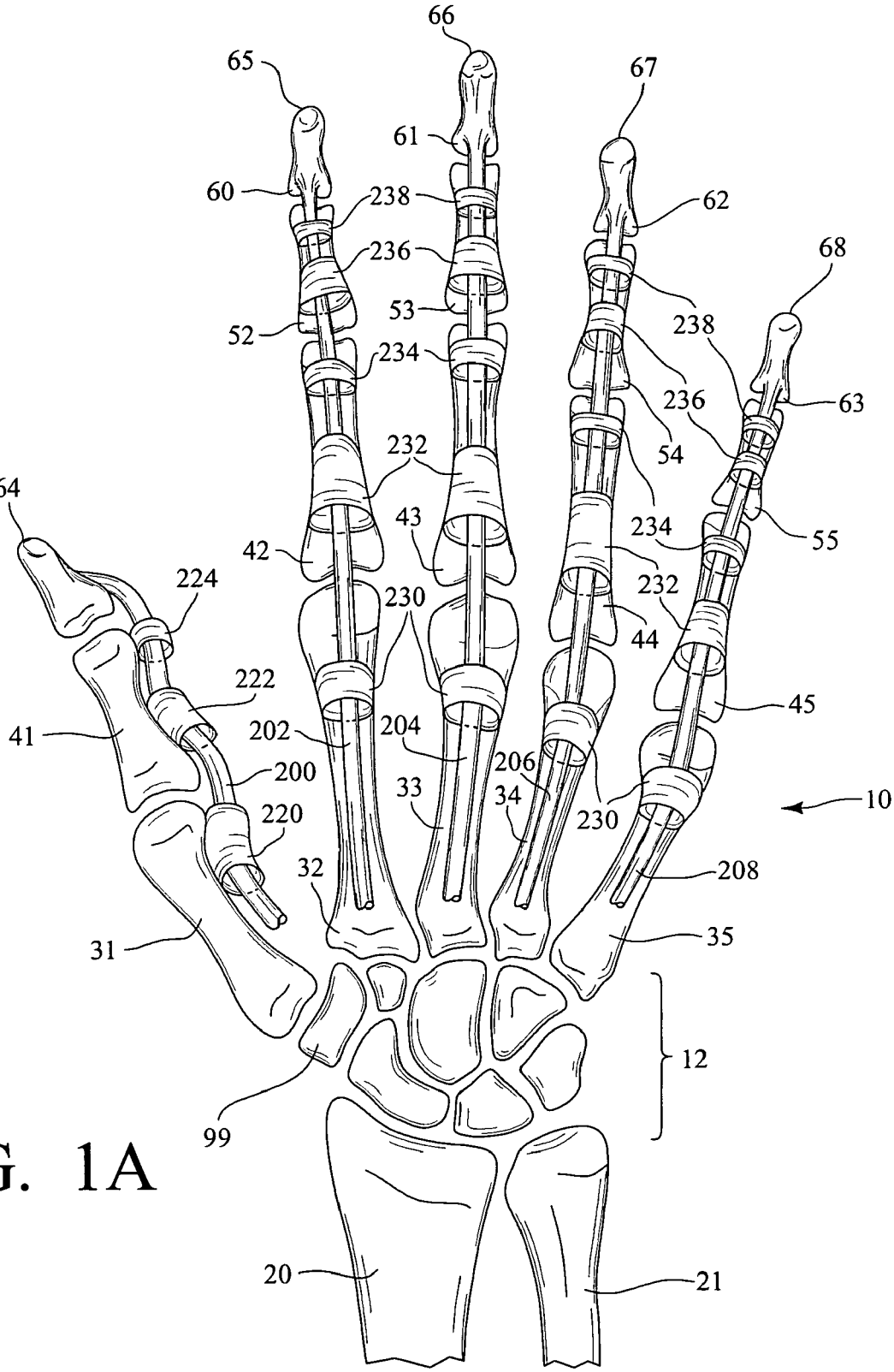
FIG. 1A is a bottom schematic anatomical palm-side view of the bones, and selected details of the pulleys and tendons of a left-side human hand.

FIG. 1*a* shows the skeletal anatomy, pulley system, and flexor tendons of the thumb 64 and fingers 65-68 of the right hand 10. The thumb 64 includes the flexor tendon (flexor pollicis longus) 200 and the three pulleys 220-224 of the thumb 64; an A1 pulley 220, A2 pulley 222, and A3 pulley 224. The A2 pulley 222 is the most important for function and is attached to the proximal phalanx 41 of the thumb 64. The respective pulleys 230-238 are also shown for each of the: index finger 65, long finger 66, ring finger 67, and small finger 68. Each finger 65-68 has five pulleys; an A1 pulley 230, A2 pulley 232, A3 pulley 234, A4 pulley 236, and A5 pulley 238. The A2 pulley 234, A4 pulley 236 are considered to be the most important for function. The A2 pulley 232 is attached to the proximal phalanx 42-45. The A4 pulley 236 is attached to the middle phalanx 52-55. The A1 pulley 230 is near the MCP joint 37-40, the A3 pulley 234 is near the PIP joint 46-50 and the A5 pulley 238 is near the DIP joint 56-59.

The flexor tendons 202-208 are shown as one unit for each finger 65-68, but actually there are two flexor tendons to each unit. They are the flexor digitorum superficialis and the flexor digitorum profundus (shown as one, 202-208). These tendons 202-208 travel underneath the pulleys 230-238 and attach to the distal phalanx 60-63 of each finger 65-68. The tendons 202-208 move back and forth below the pulleys 230-238, via muscles (not shown) attached to the proximal end of the tendons. This movement of the tendon 202-208 produces finger 65-68 flexion. The pulleys 230-238 prevent the flexor tendons 202-208 from bowstringing or moving away from the bone with finger 65-68 flexion. If the pulleys 230-238 are damaged and no longer function, the tendons 202-208 will bowstring with a resultant significant loss of finger motion as well as grip strength.

In FIGS. 2-5 a preferred ball glove 100 of the present invention is shown for use on the left hand. However, it is realized that symmetrical placement of the elements, materials, and thickness as herein described may be utilized for making a glove 100 for a right hand.

Figure 2:
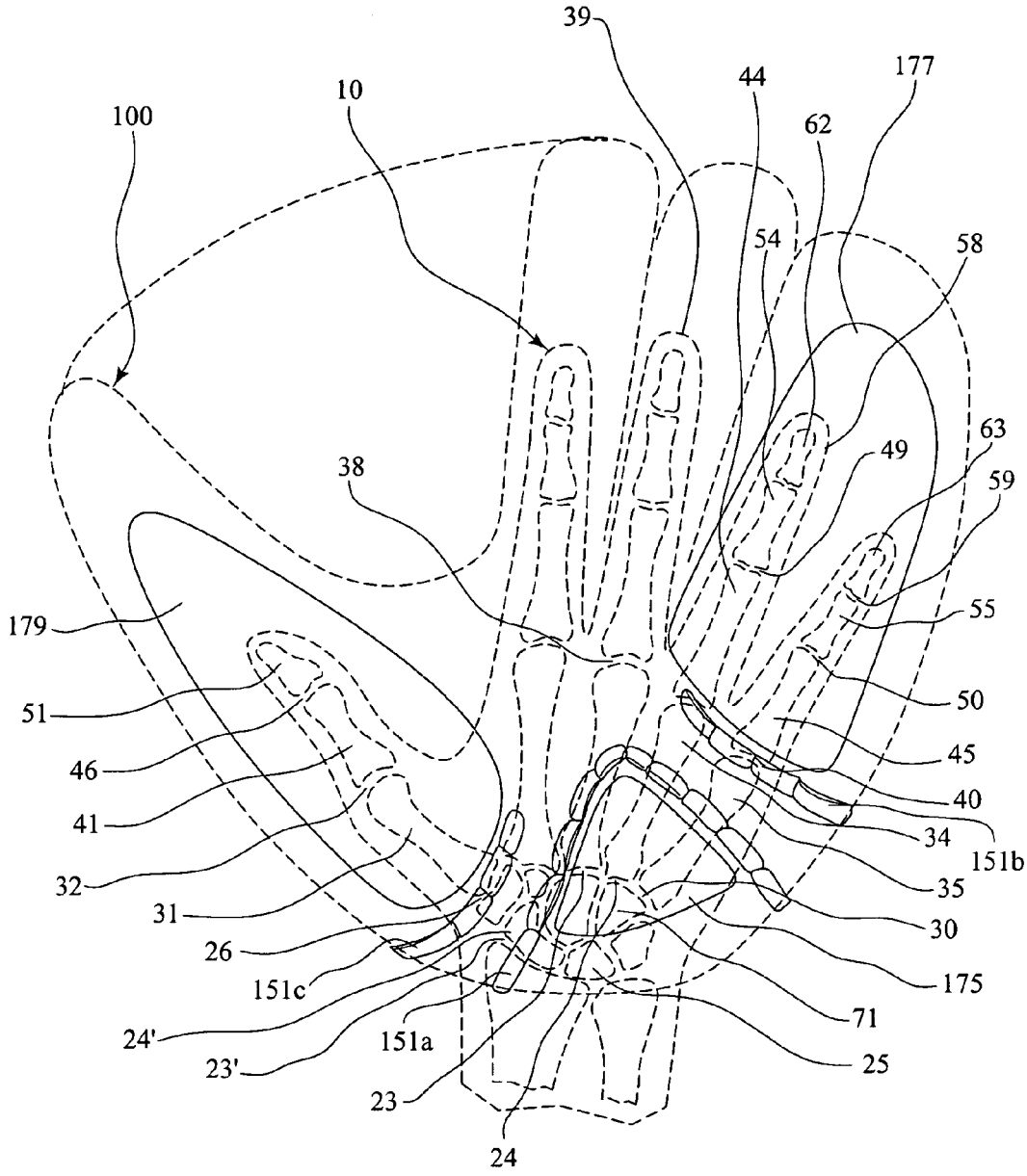
FIG. 2 is a bottom view of a ball glove of a preferred embodiment of the present invention showing the location of the padding of the present invention overlaying the skeletal structure of a left-dorsal-side human hand with selected parts of the glove and bones of the hand shown in phantom lines.

FIG. 2 shows details of a dorsal side of a ball glove 100 to cover a human hand 10 and seen overlaying the skeletal structure and skin outline of a left-dorsal-side human hand 10.

As best shown in FIG. 2, a first or palm pad 175 of generally triangular shaped configuration is positioned over the heel 145 (FIG. 3) of the palm side of the hand and is disposed below the center axis of rotation of the metacarpalphalangeal joints 38, 39 and 40 of the long finger 66, the ring finger 67 and the small finger 68, respectively, on one side and the center axis of rotation of the carpometacarpal joint 26 of the thumb 64 on an opposite side. The palm pad 175 generally terminates at the wrist 12 above the scaphoid 24' and the lunate 25, covering the hamate 71 and the proximal ends of the metacarpals 33, 34 and 35.

A second or finger pad 177 is positioned above the center axis of rotation of the metacarpalphalangeal joints 38, 39 and 40 and extends over the proximal phalanxes 44 and 45 of the ring finger 67 and the small finger 68, respectively. It is noted that there is absent of padding over the center axis of rotation of the metacarpalphalangeal joints 38, 39 and 40 which helps facilitate the glove closure between the heel of the palm and the fingers based on the true axis of rotation of the metacarpalphalangeal joints. Moreover, a third or thumb pad 179 is provided to be positioned above the center axis of rotation of the carpometacarpal joint 26 of the thumb 64 and extends along the metacarpal 31 generally beyond the distal end of the distal phalanx 51. Again, padding is absent at the center axis of rotation of the carpometacarpal joint 26 of the thumb thereby assisting or facilitating the glove closure between the thumb and the heel of the palm of the hand based upon the true axis of rotation of the carpometacarpal joint of the thumb.

Figure 5:
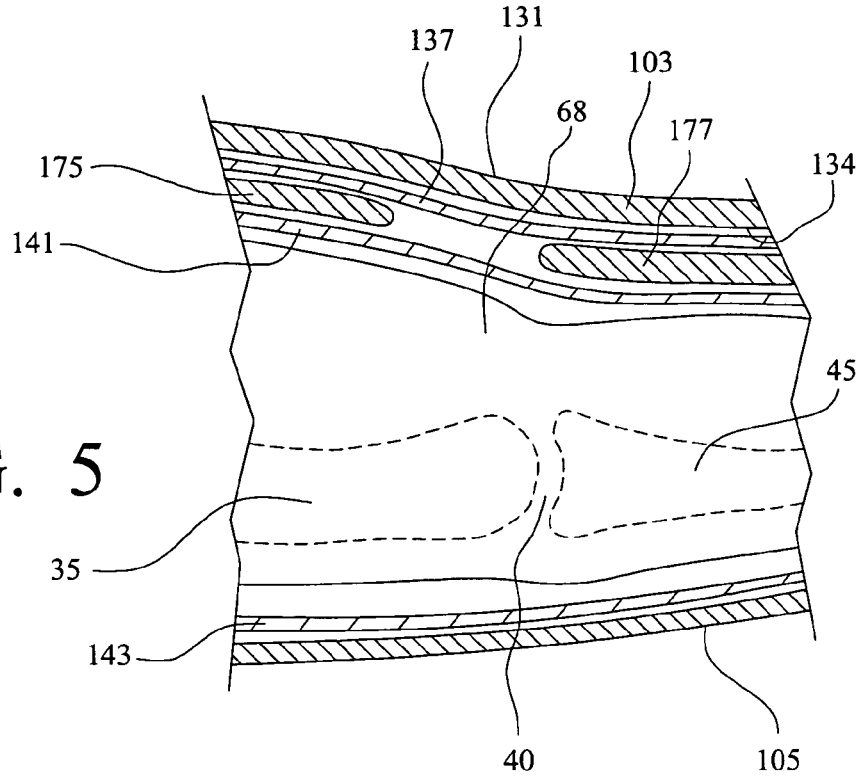
Figure 4:
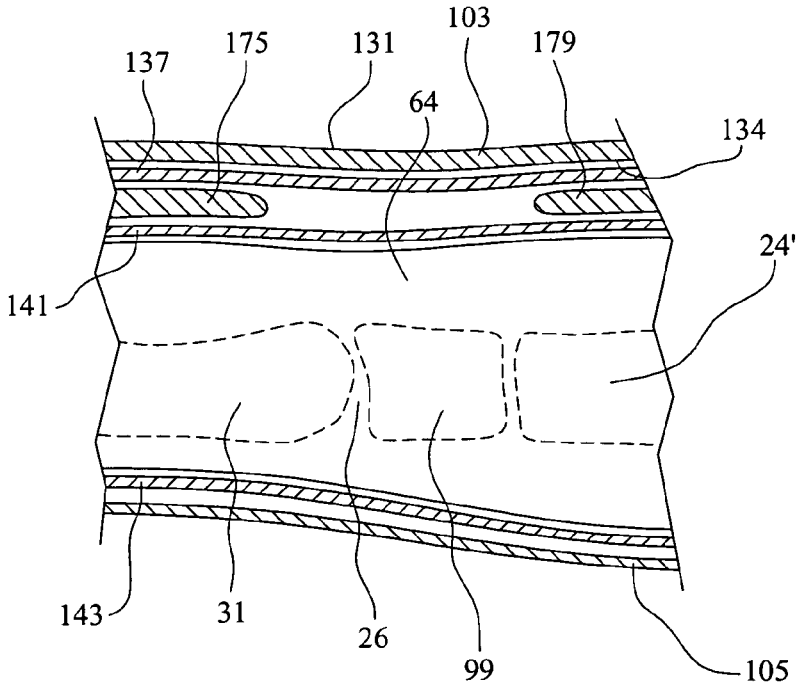
FIG. 4 is a sectional cutaway view taken along line 4-4 of FIG. 3; and, FIG. 5 is a sectional cutaway taken along line 5-5 of FIG. 3.

In FIGS. 4 and 5, the positioning of the pads 175, 177 and 179 within the body of the glove 100 are shown. Particularly, pads 175, 177 and 179 are disposed within liners 137 and 141 and are generally from about 0.25 to 0.375 inches thick.

Figure 3:
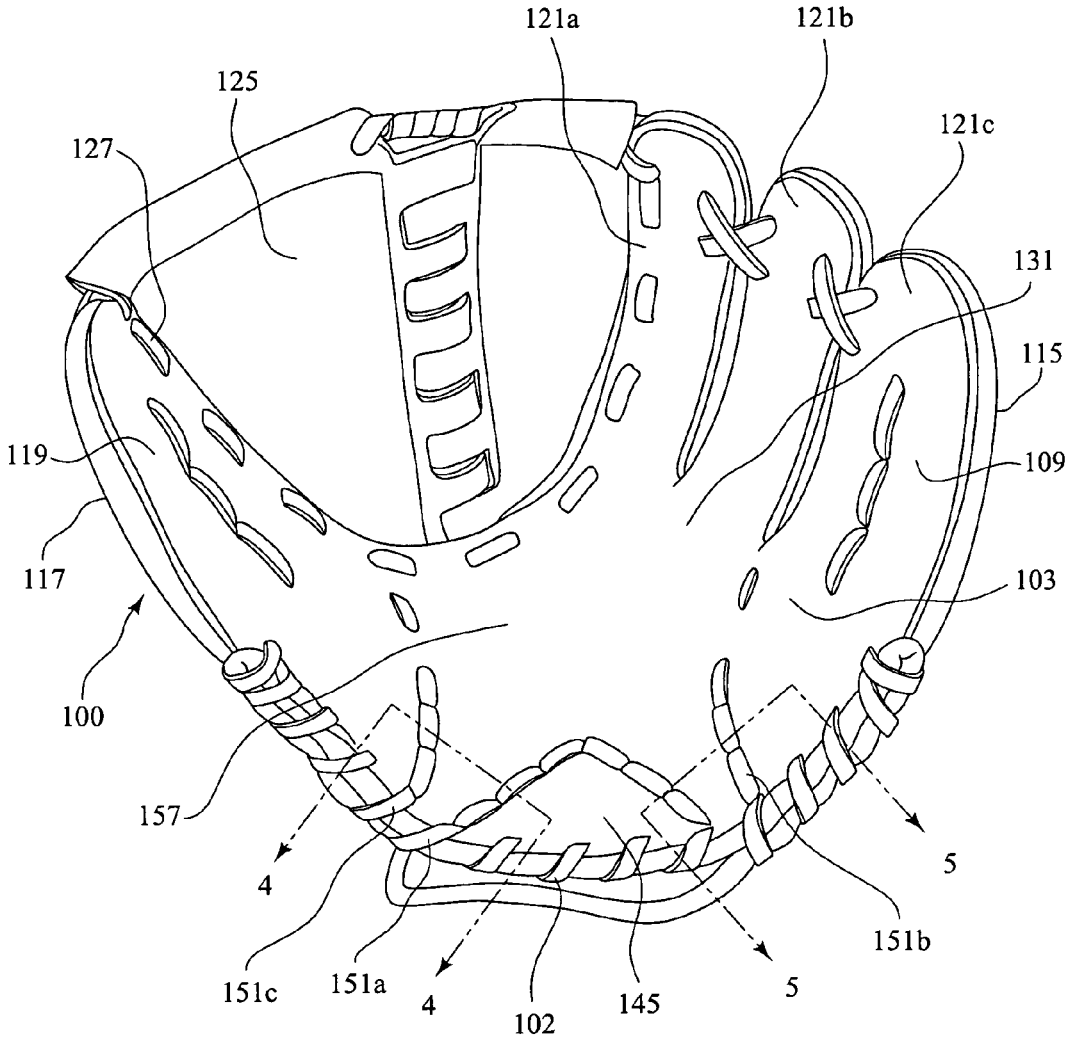
FIG. 3 is a palm side view of a preferred ball glove of the present invention.
Figure 3A:
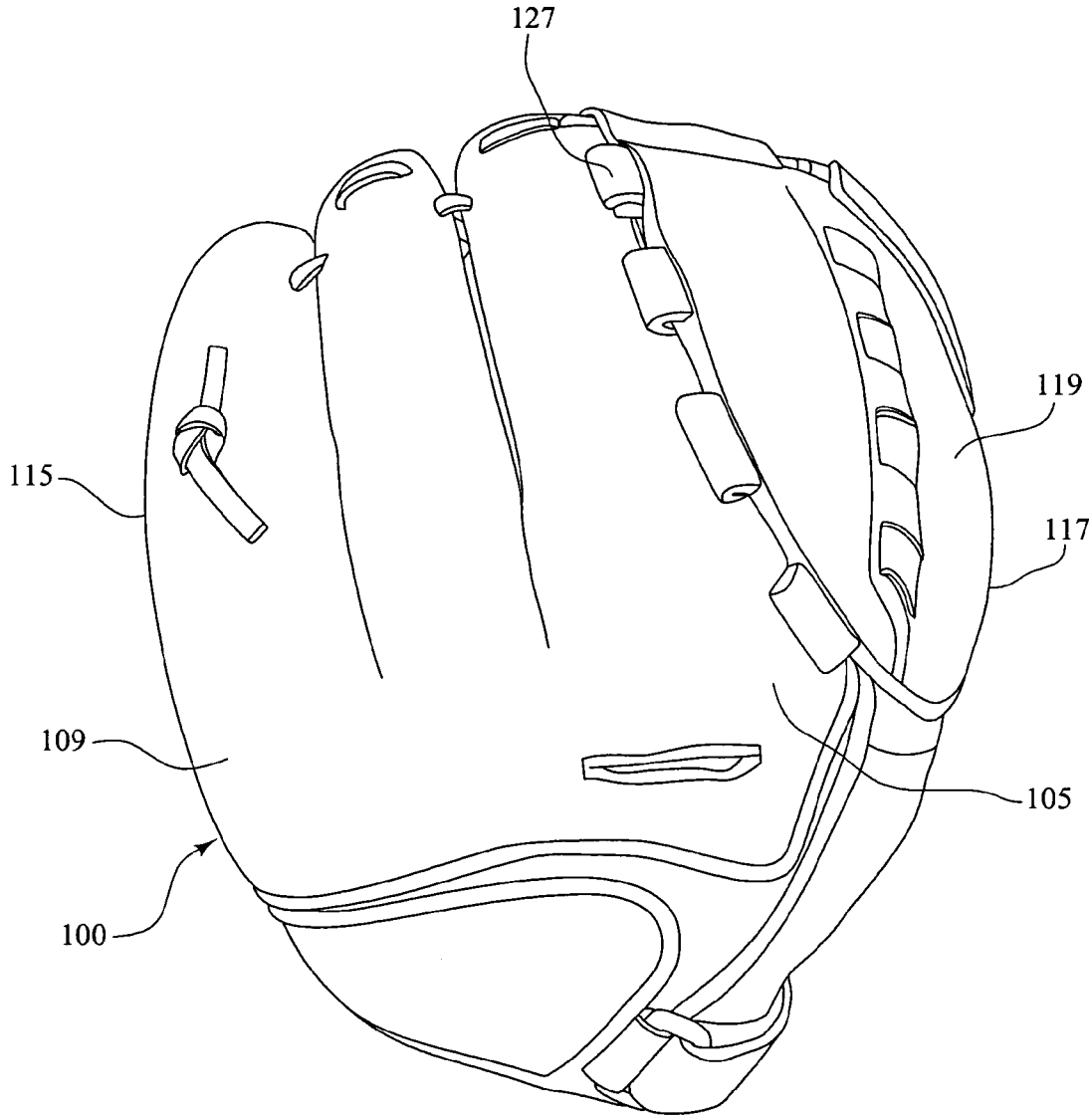
FIG. 3A is a dorsal side view of the glove of FIG. 3.

Referring now to FIGS. 3 and 3A, a glove 100 is constructed in accordance with the present invention to facilitate closure of the glove when catching a ball. The glove 100 generally includes a palmar side panel 103 and a dorsal side panel 105 with an opening 102 therebetween to receive a human hand therethrough. The palmar side panel 103 defines the bottom wall of the glove and the dorsal side panel 105 forms the top wall of the glove. The palmar side panel 103 and the dorsal side panel 105 are secured together at peripheral margins of the glove to form a glove shell 109. The glove shell 109 includes opposite sides 115 and 117 as well as a thumb stall 119 and finger stalls 121*a*, 121*b* and 121*c*. It is realized that even though in the present embodiment the fielders glove is shown as having three finger stalls, it is realized that in other designs a fielder's glove may include only one, two, or four finger stalls. A web 125 is disposed between the thumb stall 119 and the first finger or index finger stall 121*a*. The web is secured along the peripheries of the thumb stall 119 and the index finger stall 121*a* by conventional lacing 127. The palmar side panel 103 of the glove 100 is provided with an outerface 131 and an innerface 133 (FIG. 4) with a palmar shell liner 137 (FIG. 4) attached along the innerface 133. A dorsal side liner panel 143 is secured to the inner surface of the dorsal side panel 105. Padding 175, 177 and 179 are generally disposed between the liners and the panels but it is realized that the liners 137 and 141 may include a plurality of liners in which the pads 175, 177 and 179 are disposed without departing from the scope and spirit of this invention.

The palmar side panel 103 and the palm liner 137 (FIG. 4) of the glove 100 have lower edge margins generally in registry with one another to form the heel 145 of the glove which extends between opposed sides 115 and 117 of the glove 100 adjacent to the palmar side wrist area 12 of the glove 100. Lacing 151*a* passing through eyelets (not shown) secures the palmar side panel 103 and the palm liner 137 (FIG. 4) together at the bottom of the glove 100. Lacing 151*b* extends from the side 117 below the thumb stall 119, across the center axis of rotation of the carpometacarpal joint 26 of the thumb 64 and along the outer edge of the metacarpal 32 of the index finger 65, to the web 125. Lacing 151*c* extends from the side 115 below the finger stall 121*c*, across the center axis of rotation of the metacarpalphalangeal joints 40, 39 of the small finger 68 and the ring finger 67 respectively, in an angle toward the junction of the finger stall 121*c* with the finger stall 121*b*. Lacing 151*b*, 151*c*, being disposed in non-padded areas provides break or flex lines which assist in glove closure. Lacing 151*b* anatomically enables closure of the glove 100 between the fingers and the palm whereas lacing 151*c* anatomically enables closure of the glove 100 between the thumb and the palm. The outer surface 131 of the palmar side panel 103 has a central portion forming a pocket 157 therein for catching balls, the pocket 157 being located above the heel 145 of the glove 100 adjacent to a lower portion of the web 125 and the finger stalls 121*a*-121*b*.

The detailed description is given primarily for clearness of understanding and no unnecessary limitations are to be understood therefrom for modifications will become obvious to those skilled in the art upon reading this disclosure and may be made without departing from the spirit of the invention and scope of the appended claims.

What is claimed is:

1. A ball glove comprising:

a palm side, a dorsal side, a thumb stall, and a plurality of finger stalls for receipt of an index finger, a long finger, a ring finger and a small finger and an opening for receiving a person's hand;

a palm pad on the palm side disposed for location between a wrist, the center axis of rotation of the thumb carpometacarpal joint and the center axis of rotation of the metacarpalphalangeal joints of the ring finger and the small finger;

said palm pad being over the hamate and the carpometacarpal joints of said small finger and said ring finger;

said palm side being absent of padding over the center axis of rotation of the thumb carpometacarpal joint, and the metacarpalphalangeal joints of the ring finger and the small finger and including a first lacing extending from one edge of the glove across the palm side of the glove including the center axis of rotation of the thumb carpometacarpal joint to a glove web defined by the thumb stall and an adjacent finger stall.

2. The glove of claim 1, said palm pad being generally of triangular shaped configuration.

3. The glove of claim 1 including a finger pad extending distally from the center axis of rotation of the metacarpalphalangeal joint of the small finger.

4. The glove of claim 3, wherein the finger pad extends additionally distally of the metacarpalphalangeal joints of the ring finger and the small finger.

5. The glove of claim 1 including a thumb pad extending distally from the center axis of rotation of the thumb carpometacarpal joint.

6. The glove of claim 1 including second lacing extending from an opposed edge of the glove across the palm side of the glove including the center axis of rotation of the metacarpalphalangeal joints of a small finger and a ring finger to an area at least adjacent the junction of the ring finger and a long finger.

7. A ball glove having a palm side and a dorsal side comprising:

a portion for receiving fingers and a portion for receiving a thumb characterized in that;

a palm pad is disposed on the palm side of the glove for location between the wrist, the center axis of rotation of the thumb carpometacarpal joint and the center axis of rotation of the metacarpalphalangeal joints of the ring finger and the small finger;

the palm pad being over the hamate and the carpometacarpal joints of said small finger, and said ring finger;

the palm side being absent of padding over the center axis of rotation of the thumb carpometacarpal and the metacarpalphalangeal joints of the ring finger, and the small finger and including a first lacing extending from one edge of the glove across the palm side of the glove including the center axis of rotation of the thumb carpometacarpal joint to a glove web defined by the thumb stall and an adjacent finger stall.

8. The glove of claim 7, said palm pad being of generally triangular shaped configuration.

9. The glove of claim 7, including a finger pad extending distally from the center axis of rotation of the metacarpalphalangeal joint of the small finger.

10. The glove of claim 9, wherein the fingers pad extends distally beyond the metacarpalphalangeal joints of the ring finger and the small finger.

11. The glove of claim 7, including a thumb pad extending distally from the center axis of rotation of the thumb carpometacarpal joint.

12. The glove of claim 7, including second lacing extending from an opposed edge of the glove across the palm side of the glove including the center axis of rotation of the metacarpalphalangeal joints of a small finger and a ring finger to an area at least adjacent the junction of the ring finger and a long finger.

13. A ball glove constructed to facilitate closure of the glove comprising a palmar side panel and a dorsal side panel, said palmar side panel and said dorsal side panel being secured together at peripheral margins of the glove to form a glove shell having a top, bottom and opposite sides, a thumb stall for receiving the thumb of the hand and finger stalls for receiving the fingers of the hand, a web located between the thumb stall and the finger stalls, said web being secured along an inner periphery of the thumb stall and inner periphery of the finger stalls, the dorsal side panel having an outer surface and an inner surface with a palmar liner secured on the inner surface of the palmar side panel of the glove, the palmar side panel and the palm liner having lower edge margins in registry with one another to form a heel of the glove extending between opposite sides of the glove adjacent the wrist area of the glove, the outer surface of the palmar side panel of the glove having a central portion therein forming a ball-catching pocket which is disposed above the heel of the glove and below the web and the finger stalls of the glove, the glove including a flexing area enabling the glove to flex along flex lines along opposite sides of the heel, the flex lines being defined by first, second, and third lacing, said first lacing extending from one side below the thumb stall across a first area approximating the location of the center axis of rotation of the carpometacarpal joint of a thumb and along the outer edge of an area approximating the location of the metacarpal of an index finger to the web, said second lacing extending from an opposed side of the glove below the finger stalls across a second area approximating the location of the center axis of rotation of the metacarpalphalangeal joints of a small finger and a ring finger in an angle toward the junction of a finger stall for the small and ring finger with a finger stall for a long finger, and said third lacing extending on opposite sides of the heel of the glove between the first and second lacings and extending distally to an apex at the ball catching pocket of the glove with a palm pad disposed within a V-shaped formation defined by said third lacing; and, a portion of the first area defined between said first and third lacing at the base of the thumb and a portion of the second area defined between the second and third lacing at the center axis of rotation of the small and ring finger being absent of padding.

14. The glove of claim 13, including a finger pad extending distally from an area approximating the center axis of rotation of the metacarpalphalangeal joint of the small finger.

15. The glove of claim 13, including a thumb pad extending distally from an area approximating the center axis of rotation of the thumb carpometacarpal joint.

* * * * *